US009400458B2

(12) United States Patent
Yokoyama

(10) Patent No.: US 9,400,458 B2
(45) Date of Patent: Jul. 26, 2016

(54) IMAGE FORMING APPARATUS

(71) Applicant: CANON KABUSHIKI KAISHA, Tokyo (JP)

(72) Inventor: Ken Yokoyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/947,379

(22) Filed: Nov. 20, 2015

(65) Prior Publication Data

US 2016/0147182 A1 May 26, 2016

(30) Foreign Application Priority Data

Nov. 25, 2014 (JP) ..... 2014-238153

(51) Int. Cl.
*G03G 15/16* (2006.01)
*G03G 21/20* (2006.01)

(52) U.S. Cl.
CPC ..... *G03G 15/1665* (2013.01); *G03G 21/20* (2013.01)

(58) Field of Classification Search
CPC ..... G03G 15/1665; G03G 15/1675; G03G 15/657; G03G 15/6535; G03G 21/20
See application file for complete search history.

(56) References Cited

U.S. PATENT DOCUMENTS

| | | | | |
|---|---|---|---|---|
| 4,341,457 | A * | 7/1982 | Nakahata | G03G 15/1645 361/225 |
| 5,526,106 | A * | 6/1996 | Katsumi | G03G 15/6535 271/307 |
| 2005/0117939 | A1* | 6/2005 | Nakai | G03G 15/168 399/315 |
| 2012/0189330 | A1* | 7/2012 | Kunimatsu | G03G 15/657 399/44 |

FOREIGN PATENT DOCUMENTS

| | | | |
|---|---|---|---|
| JP | 2004-245858 | A | 9/2004 |
| JP | 2005-241947 | A | 9/2005 |
| JP | 2007-72001 | A | 3/2007 |
| JP | 2007-256817 | A | 10/2007 |
| JP | 2010-96921 | A | 4/2010 |

* cited by examiner

*Primary Examiner* — Sandra Brase
(74) *Attorney, Agent, or Firm* — Fitzpatrick, Cella, Harper & Scinto

(57) ABSTRACT

The image forming apparatus includes a CPU capable of executing neutralization control in which, prior to image formation, a potential difference between a voltage applied to a transfer roller by a transfer power supply and a voltage applied to a neutralization needle by a neutralization power supply is gradually increased, and a value of the potential difference when the value detected by the neutralization current meter exceeds a threshold is stored, and in which, during image formation, a value of the voltage applied by the neutralization power supply is controlled based on the stored potential difference and the value of an image formation voltage applied by the transfer power supply.

11 Claims, 7 Drawing Sheets

IMAGE FORMING APPARATUS

BACKGROUND OF THE INVENTION

1. Field of the Invention

The present invention relates to an image forming apparatus such as, a copying machine or a printer, having a function of forming images on a recording material such as a sheet.

2. Description of the Related Art

An image forming apparatus that transfers a toner image to a recording material by conveying the recording material so that the toner image borne on an image bearing member (a photosensitive drum or an intermediate transfer member) is superimposed on the recording material at a transfer portion is widely used. In such an image forming apparatus, in the process in which the recording material passes through the transfer portion, a discharge electrode as a neutralization member is sometimes disposed on the downstream side of the transfer portion in order to neutralize surplus charges injected to the recording material and to enhance separation of the recording material from the image bearing member. Japanese Patent Application Publication No. 2010-96921 discloses a configuration in which a neutralization needle as a discharge electrode is disposed on the downstream side of a transfer portion which uses a transfer roller as a transfer member.

However, the current-voltage characteristics (hereinafter referred to as I-V characteristics) between the transfer roller and the neutralization needle change depending on an individual difference (a positional relation between the transfer roller and the neutralization needle, a transfer roller resistance, and a neutralization needle shape) of the transfer unit, contamination of the neutralization needle with a long period of use, and the like.

Thus, if the voltage applied to the neutralization member is fixed, a sufficient neutralization effect may not be obtained or a surplus neutralization effect may be obtained depending on a change in the I-V characteristics.

SUMMARY OF THE INVENTION

The present invention has been made in view of the above-described problems, and an object thereof is to separate a recording material to which a toner image is transferred at a transfer portion between an image bearing member and a transfer member from the image bearing member more stably.

An object of the present invention is to provide an image forming apparatus comprising:

an image bearing member that bears a toner image;

a transfer member that forms a transfer portion between the image bearing member and the transfer member and transfers the toner image from the image bearing member to a recording material at the transfer portion;

a transfer power supply that applies a transfer voltage to the transfer member;

a neutralization member that is disposed further toward a downstream side than the transfer member in a direction of conveying the recording material so as to neutralize the recording material;

a neutralization power supply that applies a neutralization voltage to the neutralization member;

a first detection device that detects a current flowing in the neutralization member; and a control unit that controls at least the neutralization power supply, wherein the control unit changes a current value detected by the first detection device by changing a potential difference between the transfer voltage and the neutralization voltage and stores as a first potential difference the potential difference when the value detected by the first detection device exceeds a threshold, and the control unit executes neutralization control of controlling the neutralization voltage applied when neutralizing the recording material, based on the stored first potential difference and the transfer voltage.

Further features of the present invention will become apparent from the following description of exemplary embodiments (with reference to the attached drawings).

DESCRIPTION OF THE EMBODIMENTS

Hereinafter, exemplary embodiments of the present invention will be described in detail with reference to the accompanying drawings. However, dimensions, materials, shapes, relative positions, and the like of constituent components described in the embodiment are to be changed appropriately, depending on a configuration and various conditions of an apparatus to which the present invention is applied. That is, the scope of the present invention is not limited to the following embodiments.

First Embodiment

Hereinafter, a first embodiment will be described.

Figure 1:
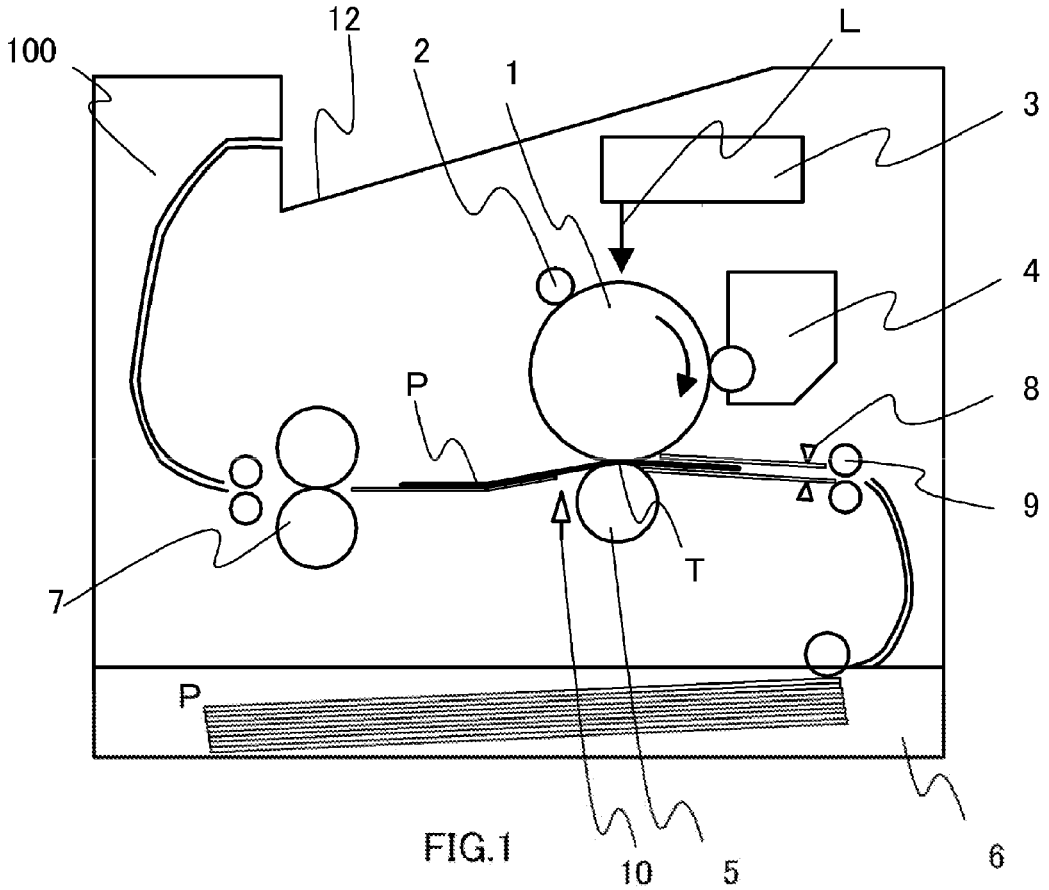
FIG. 1 is a cross-sectional view illustrating a schematic configuration of an image forming apparatus according to a first embodiment.

FIG. 1 is a cross-sectional view illustrating a schematic configuration of an image forming apparatus according to the present embodiment.

In the present embodiment, a laser beam printer (hereinafter referred to as a printer 100) will be described as an example of an image forming apparatus.

A photosensitive drum 1 as an image bearing member is rotated in the direction indicated by arrow illustrated in FIG. 1, and the surface thereof is uniformly charged by a charge roller 2. Subsequently, scanning exposure is performed by a laser scanner 3 using a laser beam L that is controlled on and off according to image information, and a latent image (an electrostatic latent image) is formed on the surface of the photosensitive drum 1. Moreover, toner adheres to the latent image by a developing operation of a developing apparatus 4 and a toner image is formed on the photosensitive drum 1.

After that, a recording material P is conveyed at a predetermined timing from a feeding cassette 6 toward a transfer portion T which is a pressure-contact portion between the photosensitive drum 1 and the transfer roller 5 as a transfer member. The recording material P conveyed to the transfer portion T is conveyed by being pinched between the photosensitive drum 1 and the transfer roller 5 at the transfer portion T by certain pressing force. In this way, the toner image formed on the photosensitive drum 1 is transferred to the recording material P.

In this case, a top sensor 8 detects a leading end of the recording material P conveyed by a conveying roller 9, whereby a conveying timing of the recording material P is synchronized with a formation timing of the toner image in the photosensitive drum 1. In this way, the image formation position of the toner image on the photosensitive drum 1 matches a writing position of the leading end of the recording material P.

The recording material P to which the toner image is transferred is conveyed to a heating device 7, and the toner image is heated by the heating device 7 and is fixed to the recording material P. After that, the recording material P is discharged to a discharge tray 12.

Figure 2:
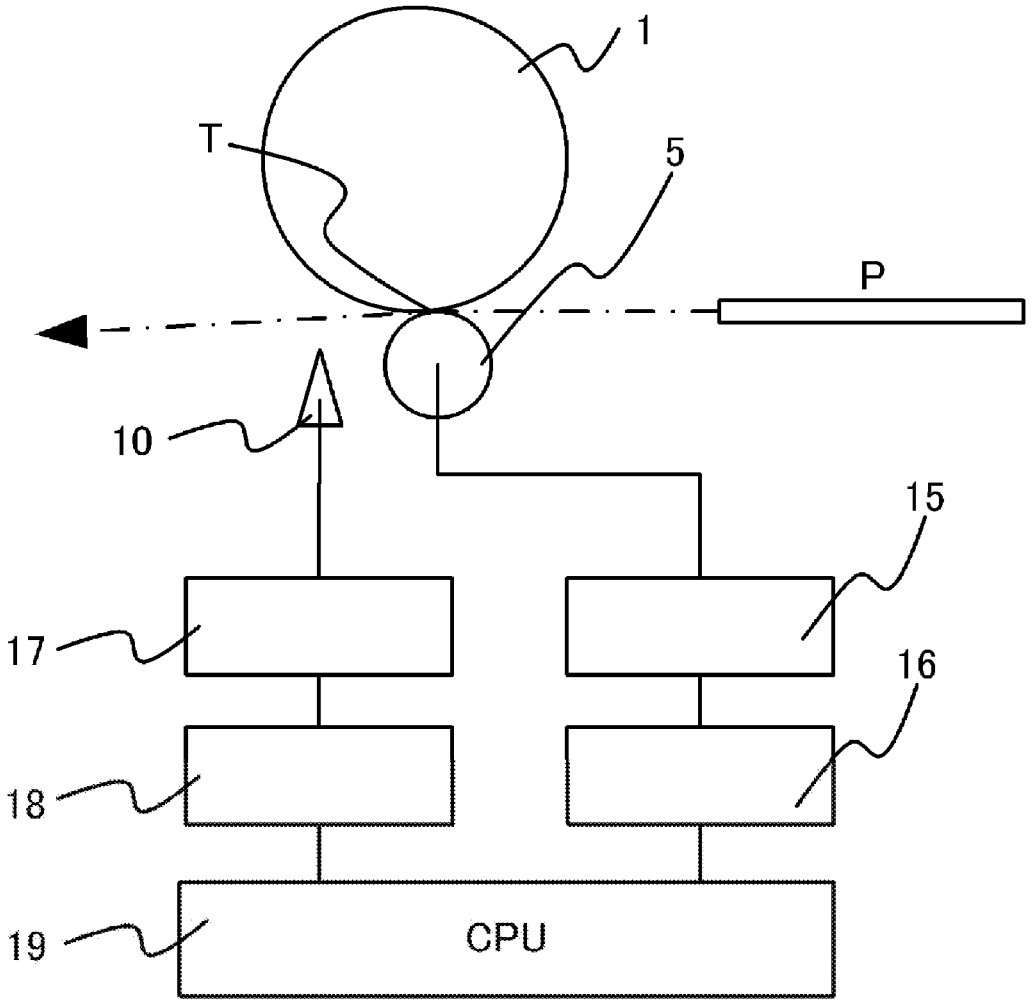
FIG. 2 is a schematic diagram illustrating a transfer portion including a neutralization portion of the image forming apparatus according to the first embodiment.

Next, the details of the transfer portion including a neutralization portion will be described with reference to FIG. 2. FIG. 2 is a schematic diagram illustrating a transfer portion including a neutralization portion of the printer 100 according to the present embodiment.

It is assumed that the diameter of the photosensitive drum 1 is 30 mm and the diameter of the transfer roller 5 is 15 mm. A neutralization needle (a discharge electrode) 10 as a neutralization member that neutralizes the recording material P is arranged on the downstream side of the transfer roller 5 in the conveying direction of the recording material P. The neutralization needle 10 is processed in a sawtooth form using a thin plate of stainless steel (SUS) 304 having a thickness of 0.2 mm, and the pitch of adjacent teeth is 2 mm. The neutralization needle 10 is disposed at a position that the neutralization needle 10 is not in contact with the transfer roller 5 and the conveyed recording material P so that the distal ends of the teeth face the rear surface of the recording material P.

The transfer roller 5 is connected to a transfer power supply 16 that applies a variable transfer voltage to the transfer roller 5 and a transfer current meter 15 as a detection unit that detects a current flowing in the transfer roller 5. Moreover, the neutralization needle 10 is connected to a neutralization power supply 18 that applies a variable neutralization voltage to the neutralization needle 10 and a neutralization current meter 17 as an acquisition unit that detects a current flowing in the neutralization needle 10. The transfer power supply 16 and the neutralization power supply 18 are controlled by a CPU 19 which is a control unit, and a voltage is applied to the transfer roller 5 and the neutralization needle 10 according to an instruction of the CPU 19. Here, the CPU 19 corresponds to a control unit and a storage unit. The CPU 19 controls at least the neutralization power supply 18, and in the present embodiment, controls both the transfer power supply 16 and the neutralization power supply 18.

The polarity of the neutralization voltage is set to be opposite to the polarity of the transfer voltage applied to the transfer roller 5. In the present embodiment, since a transfer voltage of a positive polarity is applied to the transfer roller 5, the polarity of the neutralization voltage is set to a negative polarity.

The neutralization needle 10 is disposed by being fixed to a neutralization needle holder (not illustrated). The neutralization needle holder is an insulating member mainly formed of insulated polybutylene terephthalate (PBT) and prevents a high voltage from leaking directly between the transfer roller 5 and the neutralization needle 10.

A corona discharge occurs due to the neutralization needle 10 to which the neutralization voltage is applied, and charged particles (ion current) generated due to the corona discharge are emitted to the transfer roller 5 and the rear surface of the recording material P.

When the neutralization voltage is applied to the recording material having passed through the transfer portion T by the neutralization needle 10 disposed closer to the downstream side in the conveying direction of the recording material than the transfer portion T, the charged particles on the recording material P can be neutralized. In this way, electrostatic adsorption force in relation to the photosensitive drum 1 is decreased and separation of the recording material P is improved.

Next, the flow of a series of control executed by the CPU 19 when the printer 100 receives an image formation job will be described.

When the printer 100 receives an image formation job, forward rotation starts prior to image formation. In forward rotation, startup of motors for conveying the recording material P and startup of a scanner motor and a photosensitive drum motor for image formation are performed. In parallel with the startup of the motors, the temperature control of the heating device 7 is started and an image formation voltage applied to a developing portion, a transfer portion, and the like is increased to a predetermined value. When preparation for image formation is completed by forward rotation, an image formation process is performed in the order of exposure, developing, transfer, and fixing and an image is formed on the recording material P. When image formation ends, backward rotation starts. In backward rotation, application of the respective voltages stops, the temperature control of the heating device 7 is turned off, and the respective motors are stopped. In this way, a series of image formation job ends.

Here, general transfer control will be described. Transfer control includes constant-voltage control of applying a constant voltage to the transfer portion to transfer a toner image to the recording material P and constant current control of applying a voltage so that a constant current flows in the transfer portion to transfer a toner image to the recording material P. The transfer control is appropriately selected from the two control methods depending on a main body configuration, an environment, and a recording material type. In the present embodiment, programmable transfer voltage control (PTVC) will be described as an example of constant-voltage transfer control.

In PTVC control, prior to image formation, the transfer power supply 16 applies a constant voltage of a plurality of steps to a transfer member through which the recording material P has not passed, and the transfer current meter 15 measures a current value flowing in the transfer member at each step. A transfer voltage Vt0 corresponding to the current value required for transferring the toner image is calculated by interpolation from the measured current-voltage data of the plurality of steps. Based on the calculation result, a constant voltage value Vt for image formation used during image formation is set by taking the type and the size of the recording material P into consideration.

<Unique Control of Present Embodiment>

Next, unique control (neutralization control) of the present embodiment will be described with reference to FIGS. 3A and 3B and FIG. 4.

Figure 3A:
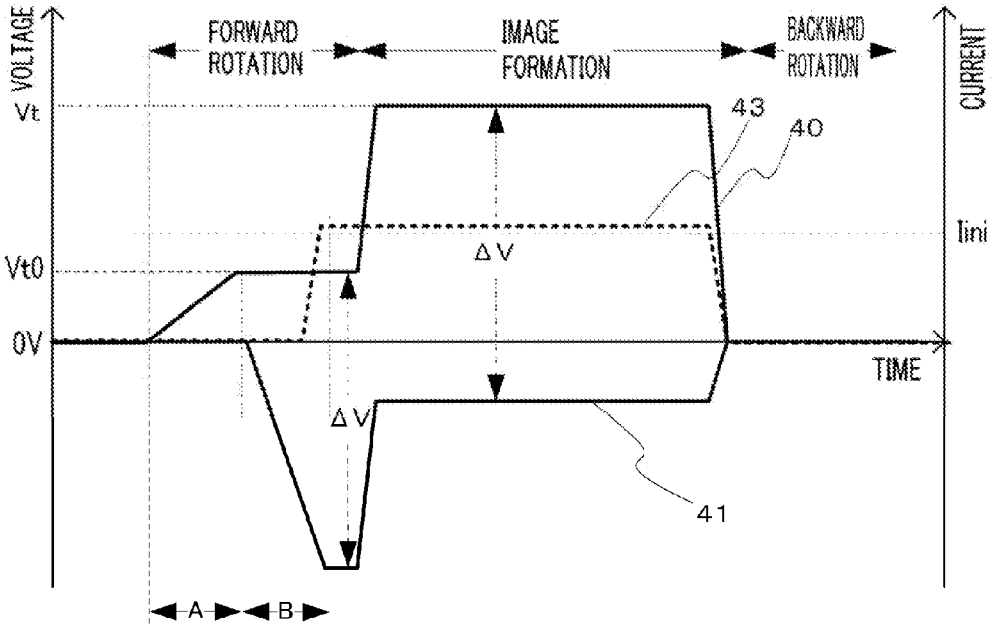
FIGS. 3A and 3B are graphs for describing transfer and neutralization processes during an image formation job according to the first embodiment.
Figure 3B:
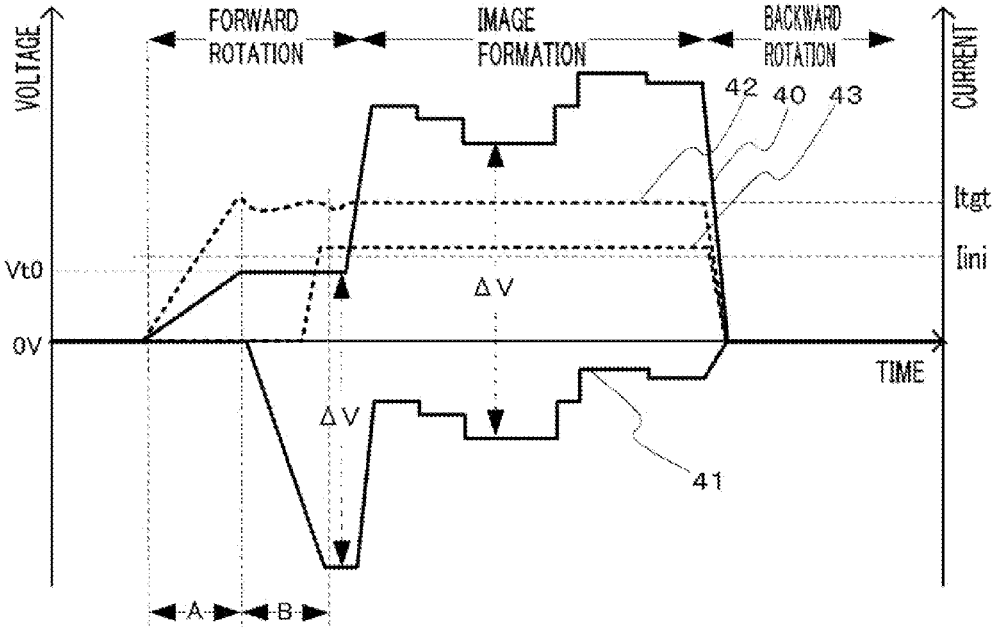
Figure 4:
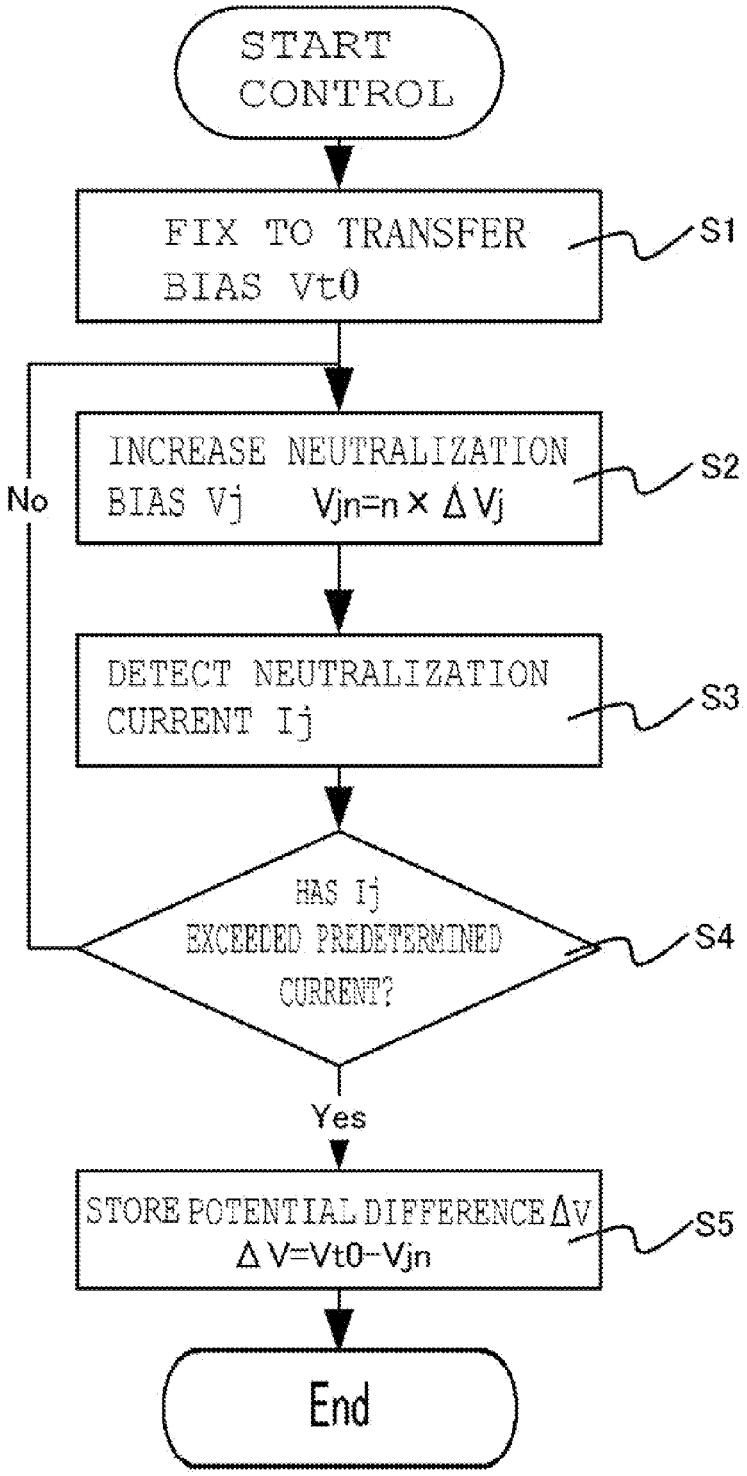
FIG. 4 is a flowchart for describing control when a neutralization condition is set according to the first embodiment.

FIGS. 3A and 3B are graphs for describing the control of transfer and neutralization processes during an image formation job. FIG. 4 is a flowchart for describing the control when a neutralization condition during image formation is set prior to image formation.

In FIGS. 3A and 3B, the horizontal axis is a time axis indicating a period that covers a series of image formation job including forward rotation, image formation, and backward rotation, and the vertical axis has a biaxial configuration in which a voltage and a current are illustrated separately such that the transfer voltage and the neutralization voltage are on the voltage axis and the transfer current and the neutralization current are on the current axis. In the series of image formation job, a solid line 40 illustrates a change with time in the transfer voltage, a solid line 41 illustrates a neutralization voltage, a broken line 42 illustrates a transfer current, and a broken line 43 illustrates a change with time in the neutralization current. Moreover, FIG. 3A illustrates a period (segment) corresponding to step S1 illustrated in FIG. 4, and FIG. 3B illustrates a period corresponding to steps S2 to S4 illustrated in FIG. 4.

First, control during forward rotation will be described with reference to FIG. 3A and FIG. 4.

When the transfer voltage Vt0 is determined by the PTVC control, the transfer voltage is fixed to the value Vt0 (S1). Next, the flow of determining the neutralization voltage which is the feature of the present embodiment will be described in detail. A neutralization voltage Vjn of a negative polarity is defined by Equation 1.

$$Vjn = n \times \Delta Vj \ (n = 0, 1, 2, 3, \ldots) \quad (1)$$

Here, n is a counter value, and ΔVj is a step value for increasing the absolute value of the neutralization voltage Vjn by a certain amount. The neutralization voltage Vjn has a starting value at n=0, and the absolute value of the neutralization voltage Vjn is increased by the step value ΔVj when the counter value n increases (S2). In this manner, the potential difference ΔV between the transfer voltage Vt0 and the neutralization voltage Vjn is increased gradually.

When the counter value n is increased by 1, the neutralization current meter 17 detects the neutralization current Ij (S3), and the CPU 19 determines whether the value (acquired value) of the neutralization current Ij exceeds a predetermined threshold neutralization current Iini (S4). Here, the threshold neutralization current Iini is a neutralization current value sufficient for a neutralization effect and is a current value required for stably separating the recording material P.

When it is determined that the neutralization current Ij exceeds a predetermined threshold neutralization current Iini, the CPU 19 calculates a potential difference ΔV between the transfer voltage Vt0 and the neutralization voltage Vjn according to Equation 2 and stores the potential difference ΔV (S5).

$$\Delta V = Vt0 - Vjn \quad (2)$$

Here, the potential difference ΔV (a potential difference when the neutralization current Ij exceeds a predetermined threshold neutralization current Iini) calculated according to Equation 2 corresponds to a first potential difference. Moreover, although the transfer voltage is fixed to Vt0 in step S1, the transfer voltage is not limited thereto, and for example, the transfer voltage may be set to a transfer voltage value at which image defects such as a photosensitive drum memory do not occur.

Next, control performed during image formation and backward rotation will be described with reference to FIG. 3A.

A transfer voltage during image formation is controlled to a constant voltage value Vt as described in the PTVC control. In this case, the neutralization voltage is controlled in relation to the constant voltage value Vt so that the potential difference ΔV between the transfer voltage Vt0 and the neutralization voltage Vjn determined in forward rotation is maintained. Since the potential difference ΔV is maintained during the image formation, the change 43 with time in the current component from the transfer roller 5 flowing in the neutralization current meter 17 is maintained to a constant value exceeding the threshold neutralization current Iini. When image formation ends, backward rotation is executed, the transfer voltage and the neutralization voltage are turned off, and the image formation job ends.

With this control, since a current sufficient for the neutralization effect flows between the transfer roller 5 and the neutralization needle 10 during image formation, it is possible to stably separate the recording material P from the photosensitive drum 1. Moreover, since a surplus neutralization current does not flow, the occurrence of toner scattering and adhering of discharge products which can cause an increase in electrical resistance of the neutralization needle 10 can be suppressed.

The unique control of the present embodiment may be set to be executed at a predetermined timing. Moreover, the timing is not particularly limited but may be set appropriately. This will be described below.

For example, when the printer 100 is used for a long period, the neutralization needle 10 may be contaminated with adhering toner or the like, and this makes it more difficult for a current to flow between the transfer roller 5 and the neutralization needle 10. In order to cope with the change in the I-V characteristics with the progress of image formation, the unique control of the present embodiment may be performed each time image formation is performed on a predetermined number of sheets to correct the potential difference ΔV for flowing a current sufficient for the neutralization effect.

Moreover, an individual difference in the I-V characteristics of the transfer unit may occur due to a positional relation between the distal end of the neutralization needle 10 and the transfer roller 5 and a variation in the shape of the neutralization needle 10 and the surrounding members. In order to cope with this individual difference, the unique control of the present embodiment may be performed whenever a transfer unit is replaced and the potential difference ΔV for flowing a current appropriate for the neutralization effect may be stored in the CPU 19. Here, the transfer unit means an assembly of members surrounding the transfer portion including the transfer roller 5 and the neutralization needle 10, having a function of aligning the neutralization needle 10 in relation to the transfer roller 5 as described above, and is configured to be replaceable.

Moreover, when the temperature and/or humidity of the atmospheres around the transfer roller 5 and the neutralization needle 10 changes, the I-V characteristics of the transfer unit may change. In order to cope with the change in the I-V characteristics, a temperature/humidity sensor as an environment detection unit may be provided in the printer (an image forming apparatus) 100, and the unique control of the present embodiment may be performed in the following cases using the detection result of the sensor. That is, the unique control of the present embodiment may be performed when the amount of change in the temperature and/or humidity from the start of execution of the previous neutralization control is a predetermined value or more. Moreover, the potential difference ΔV for flowing a current appropriate for the neutralization effect may be stored in the CPU 19.

Moreover, when image formation is performed continuously on a plurality of number of sheets of recording materials, an electrical resistance of the transfer roller may change during image formation, and the I-V characteristics of the transfer unit may change with the change in the electrical resistance of the transfer roller 5. In order to cope with the change in the I-V characteristics, even when image formation is performed continuously on a plurality of number of sheets of recording materials, the unique control of the present embodiment may be performed at the interval between sheets whenever image formation is performed on a predetermined number of sheets of recording material among the plurality of number of sheets of recording materials. In this way, the potential difference ΔV can be corrected to a potential difference for flowing a current appropriate for the neutralization effect.

Here, the case where image formation is performed continuously on a plurality of number of sheets of recording materials includes a case where image formation is performed on a plurality of number of sheets of recording materials of one image formation job and a case where image formation is performed on a plurality of number of sheets of recording materials and a plurality of image formation jobs is present. Moreover, the interval between sheets means a portion (period) in which image formation is not performed between a preceding recording material and a subsequent recording material when image formation is performed continuously on a plurality of number of sheets of recording materials.

In order to confirm the advantages of the present embodiment, a verification test was performed by passing 200,000 sheets of relatively thin recording material having a weight of 52 g/m$^2$ in an environment (temperature of 20° C. and humidity of 500).

Separation property and the current and potential difference between the transfer roller 5 and the neutralization needle 10 in a state where no recording material passes therethrough are recorded as test results. Table 1 illustrates the test results.

TABLE 1

| | | First Embodiment | Conventional Example |
|---|---|---|---|
| New Product | Current | 5 μA | 12 μA |
| | Potential Difference | 4.5 kV | 5 kV |
| | Separation Property | O | O |
| After Durability Test | Current | 5 μA | 1 μA or lower |
| | Potential Difference | 5 kV | 5 kV |
| | Separation Property | O | X |

In the conventional configuration, a constant potential difference 5 kV was applied between the transfer roller and the neutralization needle regardless of the use period of the transfer unit. Although a current of 12 μA sufficient for separation flowed in a newly produced transfer unit, substantially no neutralization current flowed after the durability test and it was not possible to stably separate the recording material.

On the other hand, in the present embodiment, a current of approximately 5 μA satisfying the separation condition flowed stably for a long period and the separation property of the recording material was secured.

In this verification test, although the threshold neutralization current Iini for securing the separation property is set to 5 μA, an optimal value may be selected arbitrarily depending on the configuration of the printer and the weight, rigidity, and the like of the target recording material.

<Unique Advantage of Present Embodiment>

As described above, with the unique transfer configuration and control of the present embodiment, even when the I-V characteristics between the transfer roller 5 and the neutralization needle 10 change, a potential difference condition for allowing a neutralization current appropriate for neutralization to flow between the transfer roller 5 and the neutralization needle 10 can be determined. Moreover, the recording material P can be stably separated by performing the unique control of the present embodiment at an appropriate timing during the use of the printer such as when image formation is performed a predetermined number of sheets of recording materials or during replacement of the transfer unit.

Here, in the present embodiment, although an embodiment in which the transfer voltage is subjected to constant-voltage control has been described, the present invention is not limited to this, but the present invention can be ideally applied to an embodiment in which the transfer voltage is subjected to constant current control. FIG. 3B illustrates the control of transfer and neutralization processes during an image formation job in an embodiment in which the transfer voltage is subjected to constant current control.

In constant current control in which a constant current flows in the transfer portion to transfer a toner image to the recording material P, the current flowing in the transfer portion during the pass of the recording material P is measured and is sequentially fed back to a transfer voltage, whereby the transfer voltage is controlled so that the transfer current converges to a desired current value Itgt. By maintaining the potential difference ΔV between the transfer roller 5 and the neutralization needle 10 determined prior to image formation according to a transfer voltage that changes according to constant current control during the image formation, it is possible to secure the separation property.

Moreover, in the present embodiment, although the neutralization voltage is controlled so that the potential difference ΔV determined in the previous neutralization control is maintained during image formation, the present invention is not limited to this. The neutralization voltage during image formation may be appropriately corrected, for example, by predicting a change of an optimal value thereof and may be determined based on the potential difference ΔV determined in the previous control. Moreover, the neutralization voltage may be determined based on the potential difference ΔV determined in the previous control during image formation and the neutralization voltage during the image formation may be controlled to be constant until the next control timing at which the potential difference ΔV is corrected.

Moreover, in the present embodiment, although the neutralization control during image formation is performed when the entire area of the recording material P passes through the transfer portion, the present invention is not limited to this. The neutralization control during image formation may be executed on a leading end of the recording material P in which the influence of separation is particularly large. This control may be disabled when the recording material P passes through the transfer portion T even after the leading end of the recording material P passed through the transfer portion T. The timing at which the neutralization control during image formation is disabled (that is, stopped) is preferably a timing at which the recording material P can be reliably separated from the photosensitive drum 1. Examples of such a timing include a timing at which a partial area including the leading end of the recording material P passes through the transfer portion T and a timing at which the leading end of the recording material P reaches the heating device 7. Here, the leading end of the recording material P corresponds to an end of the recording material P on the downstream side in the conveying direction of the recording material.

Moreover, in the present embodiment, constant voltage control is performed on the neutralization voltage during image formation in order to facilitate stable discharge between the transfer roller 5 and the neutralization needle 10. It is not preferable to perform constant current control on the neutralization voltage during image formation, in which feedback control is performed on the neutralization voltage so that the neutralization current converges to a predetermined current.

Moreover, in the present embodiment, although the neutralization condition during image formation is set prior to image formation, the present invention is not limited to this. The neutralization condition for neutralizing the recording material may be set before a toner image is transferred from the photosensitive drum 1 to the recording material Pas long as there is no influence on the image formation.

Moreover, in the present embodiment, a mono-color image forming apparatus in which a toner image is transferred directly from the photosensitive drum 1 to the recording material P has been described as an image forming apparatus. However, the present invention is not limited to this, and the present invention can be ideally applied to an intermediate transfer image forming apparatus. In an intermediate transfer image forming apparatus, a secondary transfer portion is formed between a secondary transfer member and an intermediate transfer member as an image bearing member to which a toner image is primarily transferred from a photosensitive drum, and the toner image is secondarily transferred to the recording material P when the recording material P passes through the secondary transfer portion. By applying the present invention to the intermediate transfer image forming apparatus, it is possible to reliably separate the recording material P from the intermediate transfer member.

Second Embodiment

Hereinafter, a second embodiment will be described.

In the first embodiment, prior to image formation, the potential difference ΔV set using the neutralization current Ij detected by the neutralization current meter 17 is stored, and during image formation, the neutralization voltage is controlled in relation to the image formation transfer voltage so that the potential difference ΔV is maintained.

In contrast, in the present embodiment, when the potential difference ΔV is stored prior to image formation, the potential difference ΔV is stored by acquiring the value of the neutralization current Ij flowing in the neutralization needle 10 based on the detection result of the current between the transfer roller 5 and the neutralization needle 10 detected by the transfer current meter 15. In this case, although the details will be described later, the initial value of the transfer current when the transfer voltage is fixed is stored, and the potential difference ΔV at the time point at which an increase in the transfer current from the initial value exceeds a threshold in the process of increasing the neutralization voltage to gradually increase the potential difference ΔV is stored.

<Unique Control of Present Embodiment>

The unique control of the present embodiment will be described with reference to FIGS. 5, 6, and 7.

Figure 5:
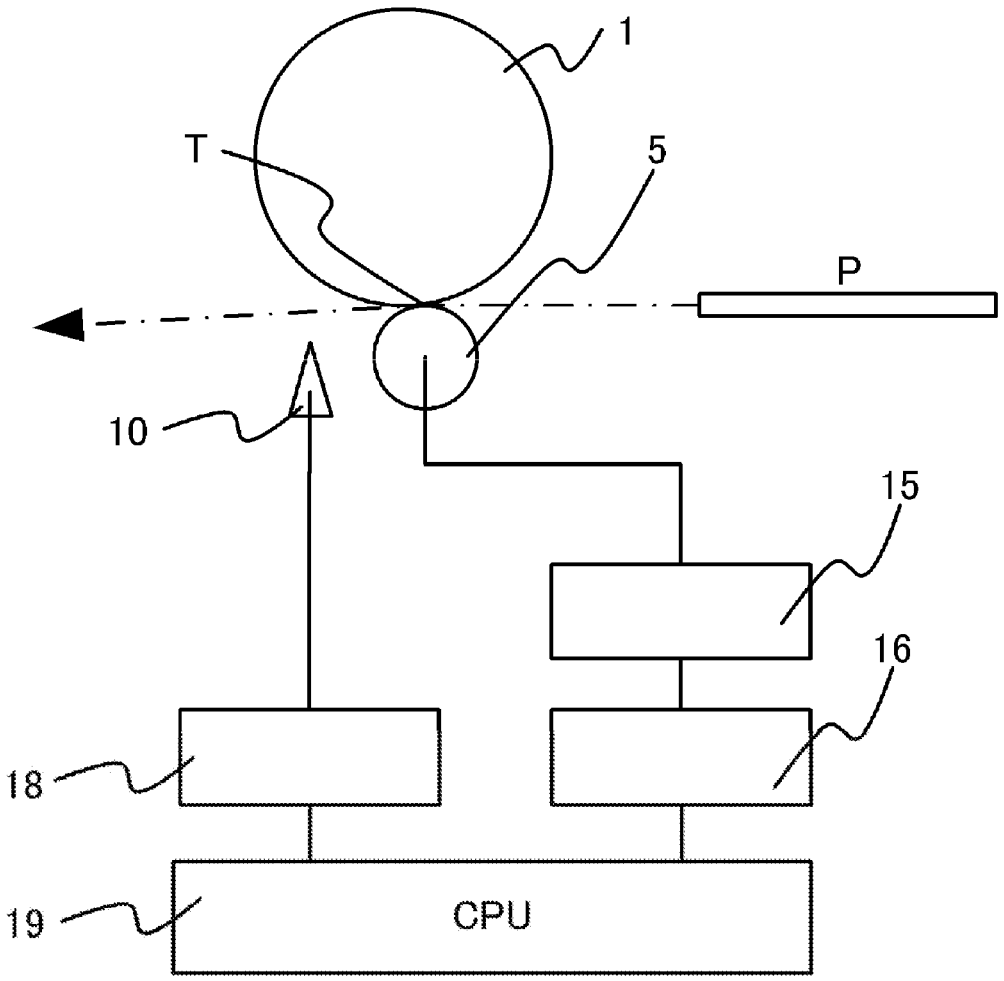
FIG. 5 is a diagram illustrating a schematic configuration of a neutralization portion and a transfer portion of an image forming apparatus according to a second embodiment.

FIG. 5 is a diagram illustrating a schematic configuration of a neutralization portion and a transfer portion according to the present embodiment and illustrates a configuration in which the neutralization current meter 17 is removed from the configuration illustrated in FIG. 2.

Figure 6:
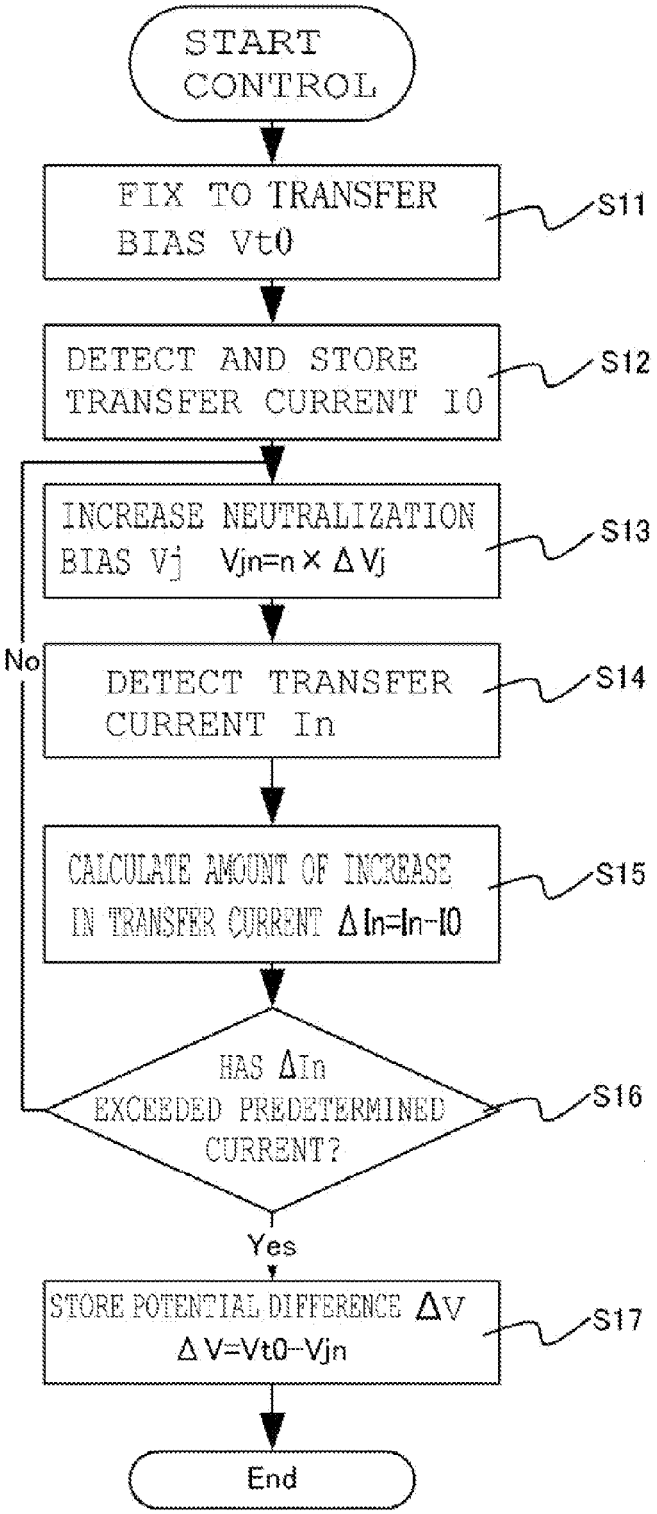
FIG. 6 is a flowchart for describing control when a neutralization condition is set according to the second embodiment.

FIG. 6 is a flowchart for describing the control when the neutralization condition during image formation is set prior to image formation according to the present embodiment. For the sake of convenience, PTVC control is used as transfer control similarly to the first embodiment.

Figure 7:
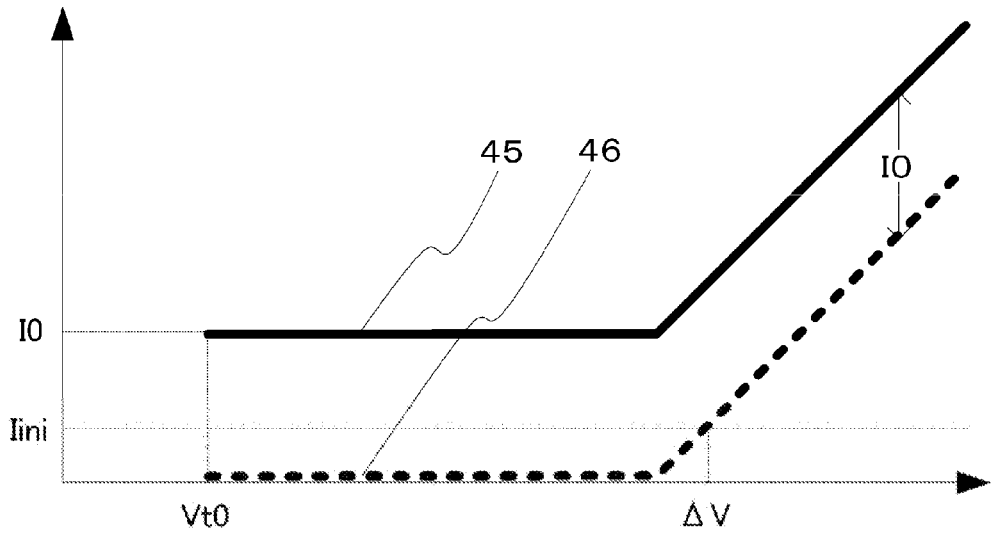
FIG. 7 is a graph for describing a transfer current and a neutralization current according to the second embodiment.

FIG. 7 is a graph for describing the transfer current and the neutralization current according to the present embodiment and is a graph in which the potential difference between the transfer roller 5 and the neutralization needle 10 is on the horizontal axis and the current value is on the vertical axis.

In FIG. 7, a solid line 45 is a read value of the transfer current meter 15 and illustrates a combined value of the transfer current and the neutralization current. A broken line 46 illustrates a so-called neutralization current which is a subtraction value obtained by subtracting the transfer current from the combined value.

As will be described later, since the transfer voltage is fixed to Vt0 (predetermined value) in a state in which no voltage is applied to the neutralization needle 10, the transfer current component flowing from the transfer roller 5 to the photosensitive drum 1 becomes a constant current value (predetermined current value) I0. In this state, when the neutralization power supply 18 applies a voltage to the neutralization needle 10 with the transfer voltage fixed, the increase in the current value measured by the transfer current meter 15 results from the neutralization current component flowing from the transfer roller 5 to the neutralization needle 10.

Hereinafter, the flowchart of FIG. 6 will be described.

When the transfer voltage Vt0 is determined by the PTVC control, the transfer voltage is fixed to the value Vt0 (S11). The transfer current meter 15 reads the transfer current value I0 at that time and stores the value in the CPU 19 (S12).

Subsequently, the neutralization voltage is determined. A neutralization voltage Vjn of a negative polarity is defined by Equation 1 similarly to the first embodiment. The neutralization voltage Vjn has a starting value at n=0, and the absolute value of the neutralization voltage Vjn is increased by the step value ΔVj when the counter value n increases (S13). When the counter value n is increased by 1, the transfer current meter 15 detects a combined value In of the transfer current and the neutralization current (S14). Moreover, the CPU 19 calculates an increase in the current value measured by the transfer current meter 15 (that is, a neutralization current value ΔIn flowing in the transfer roller 5 and the neutralization needle 10) according to Equation 3 (S15).

$$\Delta In = In - I0 \tag{3}$$

It is determined whether the neutralization current value ΔIn flowing in the transfer roller 5 and the neutralization needle 10 exceeds a predetermined threshold neutralization current Iini (S16). Here, the threshold neutralization current Iini is a current value sufficient for the neutralization effect and is a current value required for stably separating the recording material P.

When it is determined that the neutralization current value ΔIn exceeds the predetermined threshold neutralization current Iini, the CPU 19 calculates a potential difference ΔV between the transfer voltage Vt0 and the neutralization voltage Vjn according to Equation 2 described in the first embodiment and stores the potential difference ΔV (S17).

The control during image formation is performed similarly to the first embodiment. The neutralization voltage is controlled so that the potential difference ΔV determined in step S17 is maintained according to the change in the transfer voltage during image formation.

As described above, according to the present embodiment, the same advantages as the first embodiment can be obtained even when a current detection unit that detects the current flowing in the neutralization needle 10 is not provided. Moreover, since it is not necessary to provide the current detection unit for detecting the current flowing in the neutralization needle 10, it is possible to decrease the cost.

Here, in the present embodiment, since the current flowing in the transfer roller 5 and the neutralization needle 10 is detected using the current detection unit of the transfer roller 5, it is not possible to monitor the neutralization current during image formation. Thus, the first embodiment may be applied when it is necessary to monitor the neutralization current during image formation and the second embodiment may be applied when it is not particularly necessary to do so. In this way, since the embodiments can be appropriately selected depending on the configuration and use of the image forming apparatus, it is possible to ideally and stably separate the recording material P.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-238153, filed Nov. 25, 2014, which is hereby incorporated by reference herein in its entirety.

What is claimed is:

1. An image forming apparatus comprising:

an image bearing member that bears a toner image;

a transfer member that forms a transfer portion between the image bearing member and the transfer member and transfers the toner image from the image bearing member to a recording material at the transfer portion;

a transfer power supply that applies a transfer voltage to the transfer member;

a neutralization member that is disposed further toward a downstream side than the transfer member in a direction of conveying the recording material so as to neutralize the recording material;

a neutralization power supply that applies a neutralization voltage to the neutralization member;

a first detection device that detects a current flowing in the neutralization member; and a control unit that controls at least the neutralization power supply, wherein the control unit changes a current value detected by the first detection device by changing a potential difference between the transfer voltage and the neutralization voltage and stores as a first potential difference the potential difference when the value detected by the first detection device exceeds a threshold, and the control unit executes neutralization control of controlling the neutralization voltage applied when neutralizing the recording material, based on the stored first potential difference and the transfer voltage.

2. The image forming apparatus according to claim 1, wherein the control unit controls the potential difference so that the potential difference gradually increases when changing the potential difference.

3. The image forming apparatus according to claim 1, further comprising:

a second detection device that detects a current flowing in the transfer member, wherein the control unit controls the transfer power supply, based on the second detection device.

4. The image forming apparatus according to claim 3, wherein when the transfer voltage applied from the transfer power supply to the transfer member in a case where the toner image is transferred from the image bearing member to the recording material is controlled to a constant value, the control unit controls the neutralization voltage based on the constant value and the first potential difference.

5. The image forming apparatus according to claim 3, wherein when the transfer voltage applied to the transfer member is changed based on the second detection device so that the current flowing in the transfer member is controlled to a constant current in a case where the toner image is transferred from the image bearing member to the recording material, the control unit controls the neutralization voltage, based on the transfer voltage to be changed and the first potential difference.

6. The image forming apparatus according to claim 3, wherein the control unit executes the neutralization control each time image formation is performed on a predetermined number of sheets of recording material.

7. The image forming apparatus according to claim 3, wherein when image formation is performed continuously on a plural number of sheets of recording material, the control unit executes the neutralization control each time image formation is performed on a predetermined number of sheets of recording material among the plural number of sheets of recording material.

8. The image forming apparatus according to claim 3, wherein the transfer member and the neutralization member can be detachably attached as an integrated transfer unit to a main body of the image forming apparatus, and the control unit executes the neutralization control each time the transfer unit is replaced.

9. The image forming apparatus according to claim 3, further comprising:

an environment detection device that detects temperature and/or humidity of an atmosphere inside the image forming apparatus, wherein the control unit calculates an amount of change in the temperature and/or humidity in relation to a detection result of the environment detection device in previous execution of the neutralization control from the detection result of the environment detection device and executes the neutralization control when the amount of change reaches a predetermined value or more.

10. The image forming apparatus according to claim 1, wherein when executing the neutralization control, the control unit stops the neutralization control at a timing at which a partial area including an end of the recording material on the downstream side in the conveying direction passes through the transfer portion.

11. The image forming apparatus according to claim 1, wherein a polarity of the transfer voltage applied by the transfer power supply is opposite to a polarity of the neutralization voltage applied by the neutralization member.

* * * * *